United States Patent [19]

Murakami

[11] 4,211,139

[45] Jul. 8, 1980

[54] PICKUP MECHANISM

[75] Inventor: Kazuo Murakami, Hamamatsu, Japan

[73] Assignee: Nippon Gakki Seizo Kabushiki Kaisha, Japan

[21] Appl. No.: 897,405

[22] Filed: Apr. 18, 1978

[30] Foreign Application Priority Data

| | | | |
|---|---|---|---|
| Apr. 20, 1977 | [JP] | Japan | 52-48873 |
| Apr. 21, 1977 | [JP] | Japan | 52-45123 |
| Apr. 21, 1977 | [JP] | Japan | 52-49578 |
| Jun. 24, 1977 | [JP] | Japan | 52-83714 |
| Jun. 24, 1977 | [JP] | Japan | 52-83716 |
| Jun. 24, 1977 | [JP] | Japan | 52-83717 |

[51] Int. Cl.[2] ..... G10H 3/00

[52] U.S. Cl. ..... 84/1.14; 84/1.16; 84/DIG. 24

[58] Field of Search ..... 84/1.04, 1.14, 1.15, 84/1.16, DIG. 24

[56] References Cited

U.S. PATENT DOCUMENTS

| | | | |
|---|---|---|---|
| 3,049,958 | 8/1962 | Benioff | 84/1.16 |
| 3,470,305 | 9/1969 | Martin | 84/1.14 |
| 3,519,721 | 7/1970 | Martin | 84/1.14 |
| 4,084,473 | 4/1978 | Kitashima | 84/1.14 |

*Primary Examiner*—Gene Z. Rubinson
*Assistant Examiner*—William L. Feeney
*Attorney, Agent, or Firm*—Ostrolenk, Faber, Gerb & Soffen

[57] ABSTRACT

In the construction of a pickup mechanism for electric pianos, the bridge is mounted on a vibration transmitter plate of minor acoustic transmission loss and coupled to the piano plate via vibration absorbers and the pickup unit for converting acoustic vibrations into corresponding electric signals is arranged in direct contact with the transmitter plate or in contact with an intervening vibration amplifying component such as a leaf spring locally attached to the transmitter plate. Damping characteristics, especially the envelope of the tone sustain curve, is made very close to that of the natural sounds generated by non-electric pianos thanks to the damping effect and enriched sensitivity in pickup, and replacement of components out of order can be practiced very easily and simply.

16 Claims, 16 Drawing Figures

PICKUP MECHANISM

BACKGROUND OF THE INVENTION

The present invention relates to an improved pickup mechanism for electric pianos, and more particularly relates to improvement in mounting of a pickup unit such as a piezoelectric element to the bridge for purposes of generating sounds whose damping characteristics is very close to that of natural sounds generated by non-electric pianos.

In the construction of electric pianos, vibrations of strings are picked up by a pickup mechanism whose corresponding electric output signals are passed to speaker device after suitable electric amplification. In the case of the conventional pickup mechanism, the pickup unit such as a piezo-electric element is directly coupled to the bridge in order to pick up the string vibrations. This direct coupling of the pick unit does not allow sufficient mixing of vibrations from different strings and, accordingly, it is difficult to compose tones close to the natural tones generated by the non-electric pianos. In addition, since the pressure caused by string tension is imposed via the bridge upon the pickup unit in the form of static load, permanent strain may develop in the construction of the pickup unit which seriously degrades sensitivity of the pickup unit.

The above-described static load on the pickup unit causes lowering in frequency characteristics thereof while resulting in degraded tone volume and tone quality during long use of the pickup mechanism.

SUMMARY OF THE INVENTION

It is one object of the present invention to provide a pickup mechanism generative of tones whose damping characteristics, especially the envelope of the tone sustain curve, is very close to that of tones generated by non-electric pianos.

It is another object of the present invention to provide a pickup mechanism capable of retaining sensitivity and frequency characteristics of the pickup unit at high level for long period in use, thereby constantly upholding tone volume and tone quality.

It is the other object of the present invention to provide a pickup mechanism enabling easy replacement of components out of order.

In accordance with a basic aspect of the present invention, the bridge is mounted on a vibration transmitter plate of minor acoustic transmission loss and disposed to the front face of the piano plate via vibration absorbers. A pickup unit is disposed to the back face of the transmitter plate while being coupled to a given electric circuit and a slot is formed in the piano plate behind the transmitter plate for mounting of the pickup unit.

In preferred modifications of the present invention, the pickup unit is disposed a vibration amplifying component such as a leaf spring which is locally attached to the back face of the transmitter plate.

DESCRIPTION OF PREFERRED EMBODIMENTS

Figure 1:
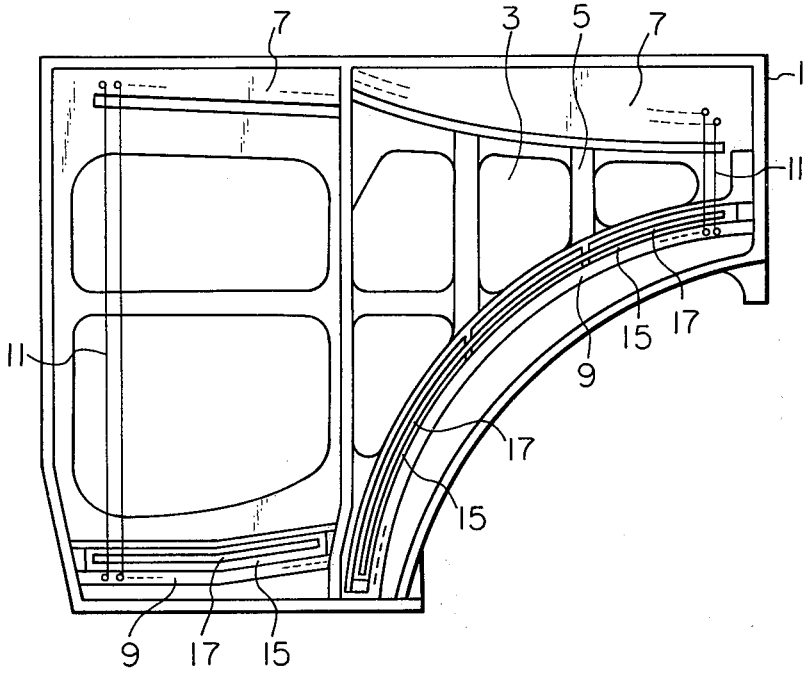
FIG. 1 is a front view of a piano plate on which the pickup mechanism in accordance with the present invention is to be embodied.

FIG. 1 depicts a typical example of the piano plate for upright type electric pianos to which the present invention is advantageously applied. The piano plate 1 is made of cast iron and several cutouts 3 are formed in the center portion thereof in order to reduce the weight of the piano plate 1, which are intervened by reinforcement ribs 5. An upper plate portion 7 for carrying a number of tuning pins extends in the width direction of the piano plate 1 and a lower plate portion 9 for carrying a number of hitch pins extends with curvature in the width direction of the piano plate. A number of strings 11 are stretched between the corresponding tuning pins and hitch pins. In the illustration, strings in the treble range are located on the right side and strings in the bass range are located on the left side. A later described elongated slot 13 (not shown in FIG. 1) is formed in the piano plate 1 while extending with curvature along the lower plate portion 9. An elongated vibration transmitter plate 15 made of a metallic material is arranged on the lower plate portion 9 while covering the elongated slot 13 and an elongated continuous bridge 17 is mounted on the transmitter plate 15 while extending almost over the entire length of the latter. In the case of the illustrated example, separate transmitter plates are used for different tone ranges.

Figure 2:
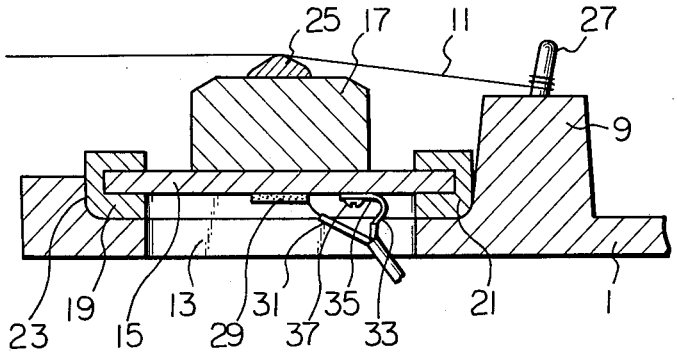
FIG. 2 is a side sectional view of one embodiment of the pickup mechanism in accordance with the present invention.

A basic embodiment of the pickup mechanism in accordance with the present invention is shown in FIG. 2, in which the vibration transmitter plate 15 is mounted on the piano plate 1 via a pair of vibration absorbers 19 and 21 firmly and elastically clamping long sides of the vibration transmitter plate 15 while covering the elongated slot 13 in the piano plate 1. A step 23 is formed on the front face of the piano plate 1 while extending along the elongated slot 13 in order to fix the mounting position of the vibration transmitter plate 15 between itself and the lower plate portion 9. The transmitter plate 15 securedly carries, on the front face thereof, the bridge 17 having a crest 25 to be in pressure contact with the strings 11 which are bound at one ends thereof to corresponding hitch pins 27 secured to the front face of the lower plate portion 9.

A pickup unit 29 such as a piezo-electric element is fixed to the back face of the transmitter plate 15 and one lead wire 31 is coupled to the outer electrode of the pickup unit 29. The inner electrode of the pickup unit 29 is in electric connection with the transmitter plate 15 as the latter is made of a metallic material. The other lead wire 33 is coupled to a terminal strap 35 fixed to the back face of the transmitter plate 15 via a fastening screw 37. Such a pickup unit 29 is provided one for a plurality of strings i.e. for a plurality of consecutive notes. For example, one unit 29 is provided for every five or six strings or notes. When a piezo-electric element is used as the pickup unit 29 and is directly disposed to the back face of the transmitter plate 15, the piezo-electric element is almost fully surrounded by walls of the elongated slot 13 and the transmitter plate 15, thereby the element being advantageously prevented against invasion of outside dust. Application of varnish to the surface of the element and its surrounding back face portion of the transmitter plate 15 assures enhanced prevension against invasion of dust and moisture.

In one practical example of the pickup unit in accordance with the present invention, the crest 25 is made of brass, the bridge 17 is made of beech, the vibration transmitter plate 15 is made of duralumin and the vibration absorbers 19 and 21 are made of urethan rubber. The bridge 17 is 24 mm. in width and 12 mm. in height, the vibration transmitter plate 15 is 80 to 100 mm. in width for bass range, 50 to 60 mm in width for trable range and 3 to 4 mm. in thickness, and the vibration absorbers 19 and 21 are 3 to 4 mm. in thickness.

Advantageously, the vibration transmitter plate 15 is made of a metal of small acoustic (or vibration) transmission loss. That is, $E/\rho$ of the vibration transmitter plate 15 is relatively large, E designating Young's modulus and $\rho$ designating specific gravity of the metallic material. By increasing the stiffness and properly designing the thickness and width of the transmitter plate 15, vibrations of the strings in different tone ranges are sufficiently transmitted to compose sounds close to natural sounds.

Through the transmitter plate 15, the vibrations of the strings are picked up by the pickup unit 29 in the form of corresponding electric vibrations and the vibratory electric output signals from the pickup unit 29 are passed to an associated electric circuit via the lead wires 31 and 33.

Since the vibration transmitter plate 15 is mounted on the piano plate 1 via the vibration absorbers 19 and 21 clamping both long sides thereof, the vibration absorbers 19 and 21 function as a kind of spring and dash pot so that the vibrations of the strings 11 transmitted to the transmitter plate 15 via the bridge 17 are absorbed by the absorbers 19 and 21. As a result of this vibration absorption, the envelope of the damping characteristics of the vibrations is made very close to that of the natural piano sounds.

Figure 3:
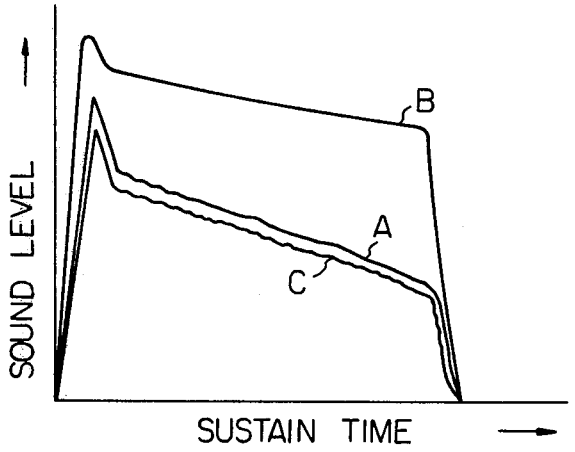
FIG. 3 is a graph for showing tone sustain curves for pianos of various types.

Sustain curves for various types of pianos are shown in FIG. 3, in which the sound level is taken on the ordinate and the sustain time is taken on the abscissa. The curve marked as A is for an electric piano having the pickup mechanism in accordance with the present invention, the curve marked as B is for an electric piano having the conventional pickup mechanism and the curve marked as C is for a usual non-electric piano. This graphical representation fairly endorses the fact that the envelope of the vibration damping characteristics of the sounds generated by the piano using the pickup mechanism in accordance with the present invention is by far closer to that of the natural sounds than that of the sounds generated by the piano using the conventional pickup mechanism.

Figure 4:
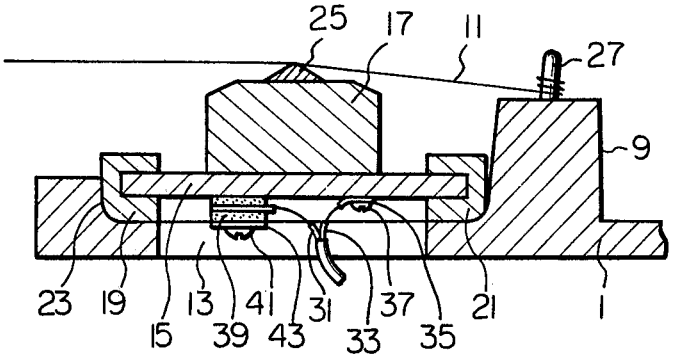
FIG. 4 is a side sectional view of a variant of the pickup unit shown in FIG. 2.

A variant of the above-described pickup mechanism is shown in FIG. 4, in which like components are designated with like reference numerals. In this embodiment, a bimorphological type ring-shaped piezo-electric element 39 is used for the pickup unit. The piezo-electric element 39 is secured to the back face of the vibration transmitter plate 15 via a fastening screw 41 and a washer 43. This construction assures easy replacement of the pickup unit.

Figure 5:
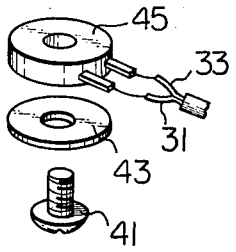
FIG. 5 is a perspective view of a pickup unit in a disassembled state usable for the construction shown in FIG. 4.

A variant of the ring-shaped piezo-electric element is shown in FIG. 5, in which the element 45 is made by moulding in order to be sealed against dust and moisture.

Since vibration of the transmitter plate 15 is damped by the vibration absorbers 19 and 21, the camping characteristics of sounds generated by a piano incorporating the pickup mechanism is quite close to that of the natural sounds. In this connection, the combination of the transmitter plate 15 with the vibration absorbers 19 and 21 operates as a member almost equivalent to the sound board used in non-electric pianos.

In the case of the above-described embodiments of the present invention, separate transmitter plates are used for different tone ranges. However, some or all of the transmitter plates made be formed in one body to each other. When the piano plate is manufactured by the known vacuum casting process, coupling precision of the transmitter plate with the piano plate can be greatly enhanced and betterment of tones can be expected for also. It is employable also that a plurality of separate pickup units are mounted to a common transmitter plate.

The vibration transmitter plate may be made of materials other than metal so long as the material has large $E/\rho$ and small acoustic (or vibration) transmission loss. When this requirement is satisfied, wood or plastics may be used for the transmitter plate. In such cases, it is necessary to use suitable metallic laminas or plates for electric connection to the electrode of the pickup unit.

Mounting of the transmitter plate to the piano plate via absorbers without using any fastening screws assures betterment in tone colour and effectively prevents undesirable transmission of mechanical vibrations to the transmitter plate via the piano plate which is generated, for example, by playing keys.

Figure 6:
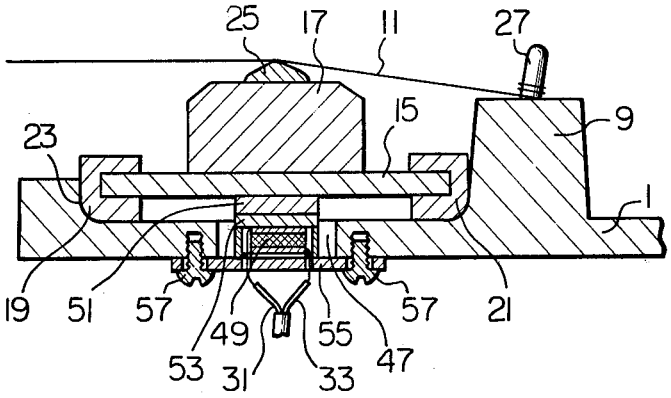
FIG. 6 is a side sectional view of another embodiment of the pickup mechanism in accordance with the present invention.

A modified embodiment of the pickup mechanism in accordance with the present invention is shown in FIG. 6, in which mounting of the vibration transmitter plate 15 and its related components to the piano plate 1 is substantially similar to that shown in FIG. 1. In this embodiment, however, one through aperture 47 for each transmitter plate 15 is formed in the piano plate 1 at a position corresponding to the middle portion of the length of the transmitter plate 15. A pickup unit 49 is accommodated within the aperture 47 while being disposed to the back face of the transmitter plate 15 via a rubber plate 51 and a plastic plate 53. A leaf spring 55 extending across the back opening of the aperture 47 is secured to the back face of the piano plate via fastening screws 57 in order to urge the pickup unit 49 into pressure contact with the back face of the transmitter plate 15. The electrodes of the pickup unit 49 is coupled to the given electric circuit via lead wires 31 and 33.

Like in the foregoing embodiments, vibrations of the strings 11 are transmitted to the transmitter plate 15 via the crest 25 and the bridge 17. Vibrations of the transmitter plate 15 is picked up by the pickup unit 49 via the plates 51 and 53 and converted into corresponding vibratory electric output signals which are passed to the electric circuit via the lead wires 31 and 33.

By adjusting the fastening screws 57 for mounting the leaf spring 55, contact pressure between the transmitter plate 15 and the pickup unit 49 can be changed freely in order to adjust the vibration pickup sensitivity of the pickup mechanism. By providing a number of threaded holes for the fastening screws 57 at different positions in the back face of the piano plate 1, the spot of contact on the back face of the transmitter plate 15 with the pickup unit 49 can be changed variously. When the aperture 47 takes the form of a slot, a wide variety of change in the above-described contact of spot is available. This change in the spot of contact enables free and delicate adjustment in the pickup sensitivity and pickup balance for vibrations of different strings. The large contact pressure between the transmitter plate 15 and the pickup unit 49 afforded by the urging spring 55 greatly enriches pickup sensitivity of the pickup mechanism, thereby enabling reduction in number of the pickup unit. When any component is out of order, replacement can easily by practiced only by loosening the fastening screws 57.

Figure 7:
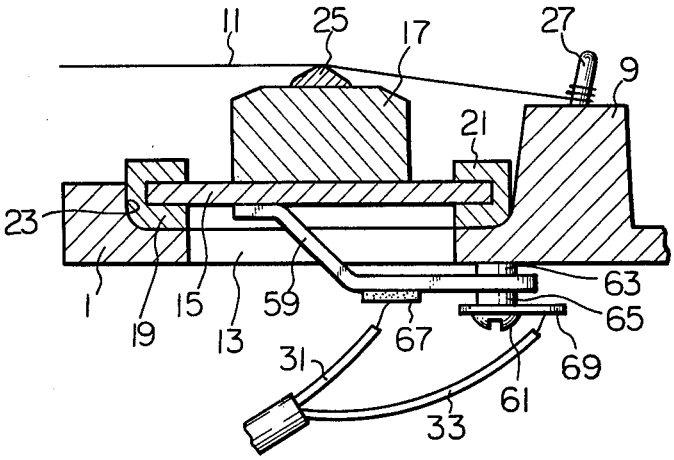
FIG. 7 is a side sectional view of the other embodiment of the pickup mechanism in accordance with the present invention.

A further modified embodiment of the pickup mechanism is shown in FIG. 7, in which a spring component is utilized also. As in the preceding embodiment like components are designated with like reference numerals. A deformed Z-shaped leaf spring 59 is secured at one end thereof to the back face of the piano plate 1 by a fastening screw 61 via a pair of washers 63 and 65 sandwiching the one end with the other end being in elastic pressure contact with the back face of the vibration transmitter plate 15. A pickup unit 67 is disposed to the leaf spring 59 at a position close to the mounting to the piano plate 1. A terminal strap 69 is fixed to the washer 65 by the fastening screw 61. The lead wire 31 is coupled to the outer electrode of the pickup unit 67 whereas the lead wire 33 is coupled to the terminal strap 69.

Vibrations of the strings 11 are transmitted to the transmitter plate 15 via the crest 25 and the bridge 17, and further to the pickup unit 67 via the leaf spring 59 in order to be converted into corresponding vibratory electric output signals.

By turning the leaf spring 59 about the axis of the fastening screw 61, the spot of contact of the spring end with the transmitter plate 15 can be changed freely. By adjusting the fastening by the screw 61, contact pressure between the spring end and the transmitter plate 15 can be finely adjusted. In order to enrich the pickup sensitivity of the pickup mechanism, the screw 61 should be strongly fastened. Replacement of wrong components can be practiced quite easily by loosening the fastening screw 61.

Figure 8:
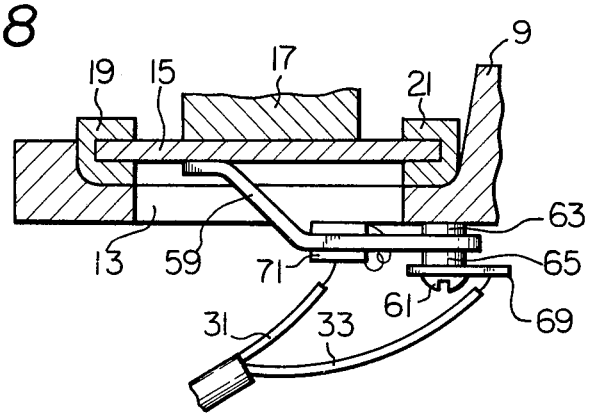
FIG. 8 is a side sectional view, partly omitted, of a variant of the pickup mechanism shown in FIG. 7.

A variant of the foregoing embodiment is shown in FIG. 8, in which a bi-morphological type ring-shaped piezo-electric element 71 such as the one used in the embodiment shown in FIG. 4 is used for the purposes of obtaining richer pickup sensitivity and better tone quality.

Figure 9:
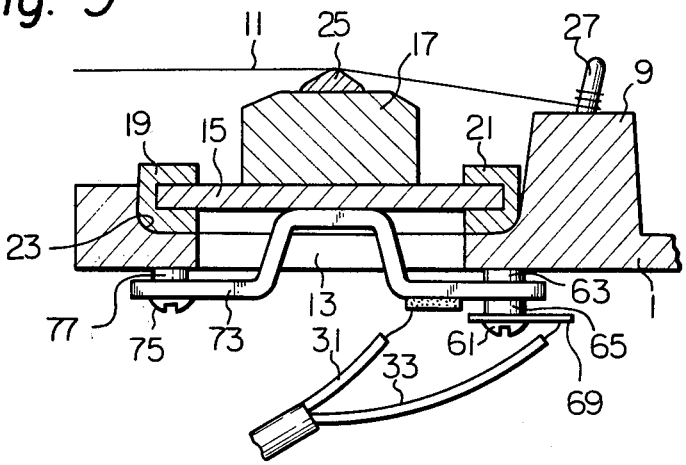
FIG. 9 is a side sectional view of a further embodiment of the pickup mechanism in accordance with the present invention.

A further variant of the foregoing embodiment is shown in FIG. 9, in which an inverted U-or/V-shaped leaf spring 73 is utilized. One end of the leaf spring 73 is secured to the piano plate 1 as in the foregoing embodiment, the other end of the leaf spring 73 that is on the other side of the elongated slot 13 is secured to the back face of the piano plate 1 via a fastening screw 75 and a washer 77, and the center apex of the leaf spring 73 is in pressure contact with the back face of the transmitter plate 15. As the leaf spring 73 is securedly held at both ends, the pressure contact of the spring 73 with the transmitter plate 15 is more stable than that in the construction shown in FIG. 7.

Figure 10:
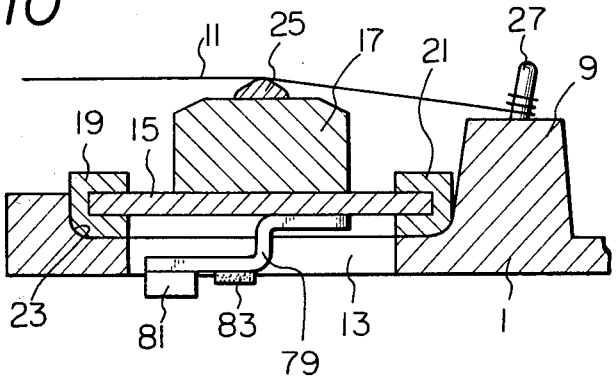
FIG. 10 is a side sectional view, partly omitted, of a still further embodiment of the pickup mechanism in accordance with the present invention.

A further modified embodiment of the pickup mechanism in accordance with the present invention is whown in FIG. 10, in which a spring component is utilized also. As in the preceding embodiment, like components are designated with like reference numerals. A deformed Z-shaped leaf spring 79 is secured at one end via suitable bonding agent to the back face of the vibration transmitter plate 15 and provided at the other end with an weight element 81. A pickup unit 83 is disposed to the back face of the leaf spring 79 at a position remote from the one end secured to the transmitter plate 15. Lead wires 31 and 33 are omitted in the drawing for purposes of simplicity.

When vibrations of the strings are transmitted to the transmitter plate 15 via the crest 25 and the bridge 17, the transmitter plate 15 starts to vibrate accordingly. This vibration of the transmitter plate 15 accompanies resonance of the leaf spring 79 which is amplified due to the presence of the weight element 81 disposed to the free end of the spring 79. Upon this resonance of the leaf spring 79, the the pickup unit 83 generates vibratory electric output signal to be passed to the associated electric circuit via the lead wires 31 and 33. Use of the cantilever-type leaf spring with the weight element 81 effect a kind of amplification of the string vibration on the process for conversion into corresponding electric signal.

Figure 11:
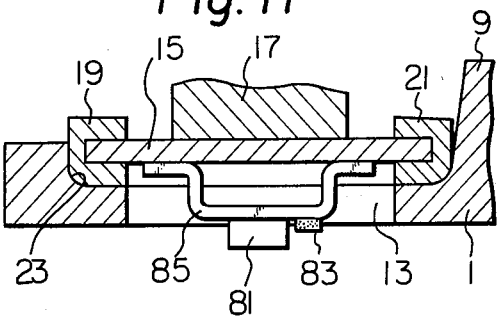
FIG. 11 is a side sectional view, partly omitted, of a variant of the pickup mechanism shown in FIG. 10.

A variant of the foregoing embodiment is shown in FIG. 11, in which a U-shaped leaf spring 85 is used as a substitute for the cantilever-type leaf spring 79 used in the foregoing embodiment. The leaf spring 85 is secured at both ends thereof via suitable bonding agent to the back face of the transmitter plate 15 and carries the weight element 81 and the pickup unit 83 about the middle thereof distant from the transmitter plate 15. When compared with the foregoing embodiment, the midway mounting of the weight element 81 results in larger resonance of the leaf spring 85, i.e. larger amplification of the string vibration on the process for conversion into corresponding electric signal.

Figure 12:
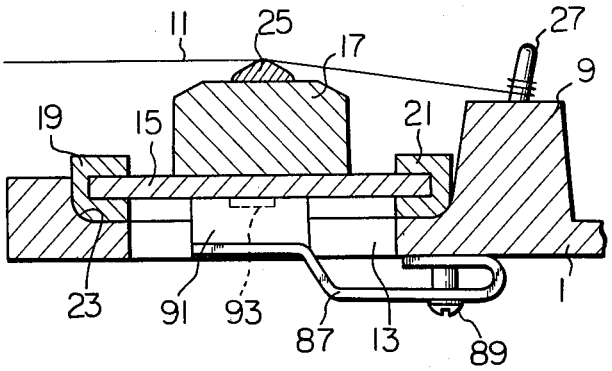
FIG. 12 is a side sectional view, partly omitted, of a still further embodiment of the pickup mechanism in accordance with the present invention.

A further modified embodiment of the pickup mechanism in accordance with the present invention is shown in FIG. 12, in which a spring component is utilized also. A deformed Z-shaped leaf spring 87 is secured at the hairpin curved end to the back face of the piano plate 1 via a fastening screw 89 and carries at the free end thereof a vibration absorber 91 incorporating a pickup unit 93 in pressure contact with the back face of the transmitter plate 15. The lead wires 31 and 33 for coupling the pickup unit to an associated electric circuit is omitted in the drawing for purposes of simplification.

String vibrations are transmitted to the pickup unit 93 via the crest 25, the bridge 17 and the transmitter plate 15 and converted into corresponding vibratory electric output signals to be passed to the electric circuit.

By adjusting the fastening screw 89, the contact pressure between the vibration absorber 91 and the transmitter plate can be adjusted as desired and this contact pressure adjustment enables free adjustment of the damping characteristics of tones. The larger the contact pressure, the longer the envelope of the tone sustain curve.

Figure 13:
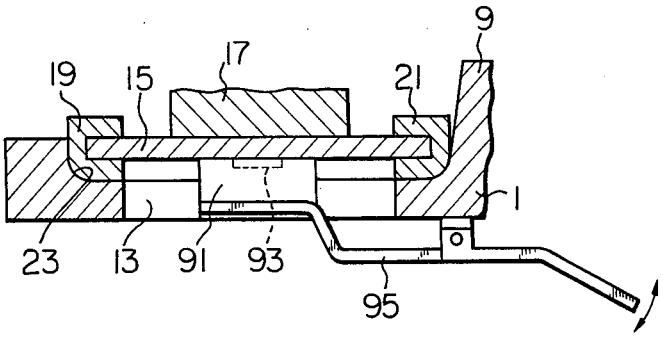
FIG. 13 is a side sectional view, partly omitted, of a variant of the pickup mechanism shown in FIG. 12, and FIGS. 14 through 16 are fragmentary perspective views of various modifications of the bridge advantageously usable for the present invention.

A variant of the foregoing embodiment is shown in FIG. 13, in which a lever component is utilized as a substitute for the leaf spring used in the foregoing embodiment. A deformed Z-shaped lever 95 is pivoted at about the middle thereof to the back face of the piano plate 1 and carries at one end thereof a vibration absorber 91 incorporating a pickup unit 93 in pressure contact with the back face of the transmitter plate 15. The other end of the lever 95 is coupled, via suitable links, to an operational terminal which can be operated from outside of the piano casing in order to swing the lever 95 as shown with an arrow in the drawing. A suitable spring biasing mechanism may be coupled to the lever 95 in order to facilitate the pressure contact between the pickup unit 93 and the transmitter plate 15.

In the case of the foregoing embodiments, the crest is made of a metallic material and the bridge is made of a wooden material whose mechanical characteristics often varies from location to location of the elongated bridge. Such local variation in the mechanical characteristics of the bridge tends to hinder uniform overall transmission of string vibrations. In order to minimize the local variation in the mechanical characteristics, it is proposed in accordance with one aspect of the present invention to make up the bridge from synthetic resin.

Figure 14:
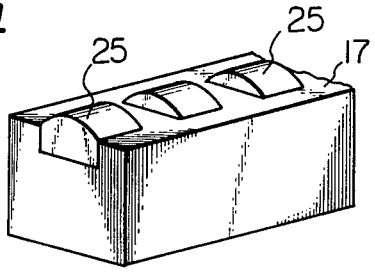

One embodiment of the bridge in this sense is shown in FIG. 14, in which crests 25 made of a metallic material are coupled in one body with a bridge 17 made of a synthetic resin by moulding. One crest is provided for each string.

Figure 15:
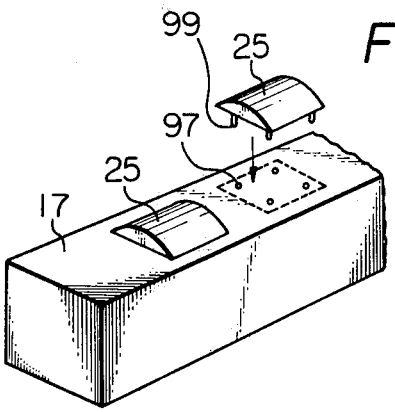

One variant of the foregoing embodiment is shown in FIG. 15, in which the bridge 17 made of a synthetic resin is provided in the front face thereof a number of holes 97 at positions corresponding to respective strings and crests 25 made of a metallic material are each provided with pins 99 projecting from the back face thereof. The crests 25 are coupled to bridge 17 with the pins 99 being snugly received in the corresponding holes 97 advantageously via suitable bonding agent.

Figure 16:
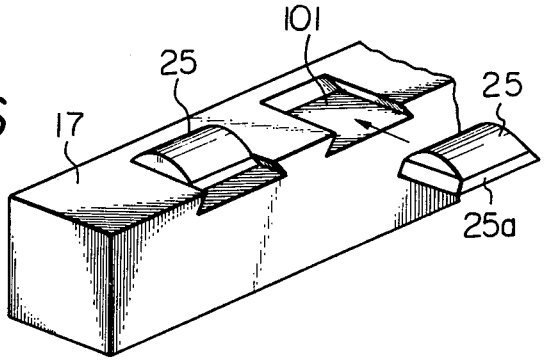

Another variant of the foregoing embodiment is shown in FIG. 16, in which the bridge 17 is provided in the front face thereof with a plurality of aligned wedge-shaped cutouts 101 and the crests 25 are each provided with a skirt 25*a*. The crests 25 are coupled to the bridge 17 with the skirts 25*a* being snugly received in the cutouts 101 advantageously via suitable bonding agent.

Use of the bridge made of synthetic resins assures uniform mechanical characteristics throughout the entire length of the elongated bridge, thereby enabling overall smooth transmission of string vibrations. Production process is remarkably simplified also.

What is claimed is:

1. An improved pickup mechanism for electric pianos comprising a bridge for engaging a string, a piano plate having a front face and being provided with an opening formed at a position corresponding to said bridge, a vibration transmitter plate having a front face and an opposite back face and the vibration transmitter plate covering the front of said opening and carrying said bridge on said front face of said vibration transmitter plate, a vibration absorbing means arranged on said front face of said piano plate on two sides of said opening and carrying said transmitter plate on said piano plate, a pickup unit disposed on said back face of said transmitter plate, and lead wires for electrically coupling electrodes of said pickup unit to an electric circuit.

2. An improved pickup mechanism as claimed in claim 1 in which said pickup unit takes the form of a piezo-electric element.

3. An improved pickup mechanism as claimed in claim 1 in which said transmitter plate has two opposing sides and is clamped at both of said opposing sides by said vibration means.

4. An improved pickup mechanism as claimed in claim 1 in which said transmitter plate is made of a material of minor acoustic transmission loss.

5. An improved pickup mechanism as claimed in claim 4 in which said material is a metallic material.

6. An improved pickup mechanism as claimed in claim 1 in which said bridge comprises a body made of a synthetic resin and having a front face, and further includes a metallic crest disposed on said front face of said resin body for engaging a string.

7. An improved pickup mechanism for electric pianos comprising a bridge, a piano plate having a front face and being provided with at least a through opening formed at a position corresponding to said bridge, a vibration transmitter plate having a front face and a back face and covering the front of said opening and carrying said bridge on said front face of said vibration transmitter plate, vibration absorbing means arranged on said front face of said piano plate on two sides of said opening and carrying said transmitter plate on said piano plate, a pickup unit arranged in pressure contact with said back face of said vibration transmitter plate, means for elastically urging said pickup unit into said pressure contact with said back face of said transmitter plate, and lead wires for electrically coupling said pickup unit to an electric circuit.

8. An improved pickup mechanism as claimed in claim 7 in which said elastically urging means comprises a deformed Z-shaped leaf spring which is secured at said deformed end to said back face of said transmitter plate and carries on its other end said pickup unit.

9. An improved pickup mechanism as claimed in claim 7, wherein said elastically urging means comprises a leaf spring having one end secured to said back face of said vibration transmitter plate; and further comprising a vibration absorber mounted on the other end of said back spring, said pickup unit being incorporated in said vibration absorber.

10. An improved pickup mechanism as claimed in claim 7 in which said vibration transmitter plate is made of a material of minor acoustic transmission loss.

11. An improved pickup mechanism as claimed in claim 10 in which said material is a metallic material.

12. An improved pickup mechanism for electric pianos each provided with a bridge, comprising a piano plate having a front face and being provided with an elongated slot formed at a position corresponding to said bridge, a vibration transmitter plate having a front face and a back face and covering the front opening of said slot and carrying said bridge on said front face of said vibration transmitter plate thereof, vibration absorbers arranged on said front face of said piano plate on two sides of said slot and carrying said vibration transmitter plate on said piano plate, a bent leaf spring having a front and a back face and having one end of said front face of said leaf spring disposed in local contact with said back face of said vibration transmitter plate, a pickup unit disposed on said back face of said leaf spring, and lead wires for electrically coupling said pickup unit to an electric circuit.

13. An improved pickup mechanism as claimed in claim 12 in which said transmitter plate is made of a material of minor acoustic transmission loss.

14. An improved pickup mechanism as claimed in claim 14 in which said material is a metallic material.

15. An improved pickup mechanism as claimed in claims 1 or 7 in which said pickup unit is entirely accommodated in the volume defined by said vibration transmitter plate and said opening in said piano plate.

16. An improved pickup mechanism as claimed in claim 7 in which said means for elastically urging said pickup unit against said transmitter plate can be adjusted to vary selectively the force with which said pickup unit is urged against said vibration transmitter plate.

* * * * *